US012082643B2

(12) United States Patent
Yoshida

(10) Patent No.: US 12,082,643 B2
(45) Date of Patent: Sep. 10, 2024

(54) SOLE STRUCTURE AND SHOES HAVING THE SAME

(71) Applicant: MIZUNO CORPORATION, Osaka (JP)

(72) Inventor: Yohei Yoshida, Osaka (JP)

(73) Assignee: Mizuno Corporation, Osaka (JP)

( * ) Notice: Subject to any disclaimer, the term of this patent is extended or adjusted under 35 U.S.C. 154(b) by 47 days.

(21) Appl. No.: 17/571,711

(22) Filed: Jan. 10, 2022

(65) Prior Publication Data

US 2022/0312891 A1 Oct. 6, 2022

(30) Foreign Application Priority Data

Mar. 31, 2021 (JP) ..... 2021-060946

(51) Int. Cl.
*A43B 13/14* (2006.01)
*A43B 13/12* (2006.01)

(52) U.S. Cl.
CPC ..... *A43B 13/14* (2013.01); *A43B 13/127* (2013.01)

(58) Field of Classification Search
CPC ..... A43B 3/0073; A43B 5/06; A43B 7/142; A43B 7/143; A43B 7/1435; A43B 7/144; A43B 7/1445; A43B 7/18; A43B 7/22; A43B 7/223; A43B 13/127; A43B 13/14; A43B 13/143; A43B 13/185; A43B 21/24
USPC ..... 36/25 R, 30 R
See application file for complete search history.

(56) References Cited

U.S. PATENT DOCUMENTS 748,553 A * 12/1903 Arrowsmith ..... A43B 7/142 36/181
1,667,359 A * 4/1928 Sessler ..... A43B 7/142 36/161
1,727,244 A * 9/1929 McNiff ..... A43B 7/142 36/176

(Continued)

FOREIGN PATENT DOCUMENTS

JP 2001008704 A 1/2001
JP 2017131656 A 8/2017

(Continued)

OTHER PUBLICATIONS

Office Action issued in Japanese Application No. 2021-060946.

*Primary Examiner* — Heather Mangine
*Assistant Examiner* — Matthew R Marchewka
(74) *Attorney, Agent, or Firm* — Troutman Pepper Hamilton Sanders LLP; James E. Schutz; Korbin M. Blunck

(57) ABSTRACT

A sole structure includes a first midsole portion, a second midsole portion disposed below the first midsole part, and a support plate stacked between the first midsole portion and the second midsole portion, disposed at a location corresponding at least to a hindfoot portion, and having a higher rigidity than the first midsole portion and the second midsole portion. The support plate includes: a base portion having a corrugated shape with at least one peak and at least one valley; and first and second support portions having a corrugated shape and branched apart from each other from a peripheral edge portion located on an inner side of the base portion toward the first midsole portion and the second midsole portion, respectively. The valley of the second support portion is disposed at a location corresponding to a sustentaculum tali.

7 Claims, 14 Drawing Sheets

(56) References Cited

U.S. PATENT DOCUMENTS

| | | | | |
|---|---|---|---|---|
| 5,164,878 | A * | 11/1992 | Hauser | A43B 7/1445 36/166 |
| 6,289,608 | B1 | 9/2001 | Kita et al. | |
| 6,976,322 | B1 * | 12/2005 | Walker | A43B 7/223 36/43 |
| 2004/0123495 | A1 | 7/2004 | Greene et al. | |
| 2008/0127526 | A1 * | 6/2008 | Spicer | A43B 7/223 36/145 |
| 2011/0030245 | A1 * | 2/2011 | Truelsen | A43B 13/12 36/76 R |
| 2011/0197469 | A1 | 8/2011 | Nishiwaki et al. | |
| 2012/0323724 | A1 * | 12/2012 | Luthi | A43D 1/02 36/43 |
| 2014/0165424 | A1 * | 6/2014 | Torrance | A43B 3/0031 36/91 |
| 2014/0223778 | A1 * | 8/2014 | Horacek | A43B 13/141 36/102 |
| 2016/0227874 | A1 | 8/2016 | Tzeng | |
| 2017/0258176 | A1 * | 9/2017 | Waatti | A43B 7/141 |
| 2018/0263335 | A1 | 9/2018 | Iuchi et al. | |
| 2020/0214388 | A1 * | 7/2020 | Sterman | A43B 7/142 |

FOREIGN PATENT DOCUMENTS

| | | | |
|---|---|---|---|
| JP | 2018153355 | A | 10/2018 |
| WO | 2010049983 | A1 | 5/2010 |

* cited by examiner

SOLE STRUCTURE AND SHOES HAVING THE SAME

CROSS-REFERENCE TO RELATED APPLICATION

This application claims priority to Japanese Patent Application No. 2021-060946 filed on Mar. 31, 2021, the entire disclosure of which is incorporated by reference herein.

BACKGROUND

The present disclosure relates to a sole structure and a shoe having such a sole structure.

Shoe structures for a shoe have been proposed like a sole structure of Japanese Unexamined Patent Application No. 2001-8704, for example.

Japanese Unexamined Patent Application No. 2001-8704 discloses a shoe sole structure including an upper midsole formed of a soft elastic member, a lower midsole disposed below the upper midsole and formed of a soft elastic member, and a corrugated sheet disposed between the upper midsole and the lower midsole and disposed at a location corresponding to a hindfoot portion of a foot of a wearer. The corrugated sheet is made of a hard elastic material having a higher hardness than the upper midsole and the lower midsole, and is formed of a single plate member having a corrugated shape.

SUMMARY

In general, a runner who prefers efficient running with a better feeling of running tends to require a sole structure for running shoes to have cushioning properties when the running shoes contact a ground or road surface during running (hereinafter referred to as "upon grounding"). Upon grounding, an impact (an initial impact) mainly in the vertical up-down direction is generated around a hindfoot portion (a heel portion) of a foot of a wearer. The above-described impact is appropriately attenuated by the cushioning properties.

On the other hand, a sole structure with higher cushioning properties tends to make a location corresponding to a foot bone called a sustentaculum tali upon grounding during running instable, and tends to generate a phenomenon called overpronation in which the calcaneus of the foot of the wearer excessively falls inward of the sustentaculum tali as a starting point after the grounding. Such overpronation causes a burden on various portions of a lower limb linked to the calcaneus, and a running disorder accompanied by chronic pain may occur at these portions.

Here, in the sole structure of Japanese Unexamined Patent Application No. 2001-8704, in a cutting plane when the sole structure is cut along a foot width direction at a location corresponding to the hindfoot portion of the foot of the wearer, each of the upper midsole and the lower midsole has a substantially constant thickness along the foot width direction (see FIG. 6 of Patent Document 1). The corrugated sheet also has a substantially constant thickness along the foot width direction. That is, the sole structure uniformly has cushioning properties and rigidity along the foot width direction in the cutting plane. However, a sole structure with higher cushioning properties for attenuating the impact upon grounding has an insufficient rigidity required for the entire calcaneus including the sustentaculum tali of the foot of the wearer. As a result, the entire calcaneus including the sustentaculum tali of the foot of the wearer tends to be instable, possibly resulting in promoting the overpronation.

The present disclosure has been made in view of the foregoing background, and it is an object of the present disclosure to achieve a favorable feeling particularly during running.

In order to achieve the above-described object, a first aspect of the present disclosure is directed to a sole structure for a shoe, the sole structure including a first midsole portion disposed on a side on which the planta of a wearer is located, a second midsole portion disposed below the first midsole portion, and a support plate stacked between the first midsole portion and the second midsole portion, disposed at a location corresponding at least to a hindfoot portion of a foot of the wearer, and having a higher rigidity than the first midsole portion and the second midsole portion. The support plate includes a base portion having a corrugated shape with at least one peak and at least one valley and first and second support portions branched apart from each other from a peripheral edge portion located on an inner side of the base portion toward the first midsole portion and the second midsole portion, respectively. The first support portion has an upper surface continuous with an upper surface of the base portion, and has a corrugated shape with at least one peak and at least one valley. The second support portion is located below the first support portion, and has a corrugated shape with at least one peak and at least one valley. The valley of the second support portion is disposed at a location corresponding to the sustentaculum tali of the foot of the wearer.

In the first aspect of the present disclosure, the sole structure includes the first midsole portion, the second midsole portion, and the support plate. This enables the first midsole portion and the second midsole portion to provide cushioning properties to the sole structure and the support plate to stably support the planta. In addition, the support plate has the double structure including the first and second support portions vertically branched from the peripheral edge portion located on the inner side of the base portion. This can particularly increase the rigidity of a portion corresponding to the inner side of the foot to particularly stably support an inner longitudinal arch. The second support portion has the valley disposed at the location corresponding to the sustentaculum tali. This allows the second midsole portion to have a thinner thickness at the location corresponding to the sustentaculum tali. That is, the second midsole portion is thinner below the valley of the second support portion than below the peak of the second support portion. This can particularly enhance the rigidity of the portion supporting the sustentaculum tali as the starting point of the overpronation, possibly reducing sinking of the sole structure at the sustentaculum tali portion. The above-described configuration can reduce the overpronation. This can achieve a favorable feeling of running.

A second aspect of the disclosure is an embodiment of the first aspect. In the second aspect, the valley of the second support portion has a lowermost portion disposed at a location corresponding to the sustentaculum tali of the foot of the wearer.

In the second aspect of the present disclosure, the lowermost portion of the valley of the second support portion is disposed at the location corresponding to the sustentaculum tali. Such a disposition can maximize the rigidity of the portion supporting the sustentaculum tali as the starting point of occurrence of the overpronation to reduce the overpronation. This can achieve a favorable feeling of running.

A third aspect of the disclosure is an embodiment of the first or second aspect. In the third aspect, the valley of the base portion is disposed at a location corresponding to the calcaneus of the foot of the wearer, and in a cutting plane when the sole structure is cut along a foot width direction at a location corresponding to the calcaneus of the foot of the wearer, the valley of the base portion has a bowl shape such that a substantially center portion of the valley is recessed downward.

In the third aspect of the present disclosure, the valley of the base portion has such a bowl shape recessed downward along the calcaneus. Such a configuration stably supports the hindfoot portion at the valley of the base portion when a load is applied to the calcaneus and the first midsole portion is compressively deformed at a location corresponding to the hindfoot portion. That is, the configuration reduces shift of the hindfoot portion from the sole structure. This can maintain a positional relationship between the sustentaculum tali and the valley of the second support portion to maintain the above-described advantage of reducing sinking of the sustentaculum tali portion into the sole structure. This can achieve a favorable feeling of running.

A fourth aspect of the disclosure is an embodiment of the first or second aspect. In the fourth aspect, the support plate is disposed to include an area ranging from a location corresponding to a midfoot portion of the foot of the wearer to a location corresponding to a hindfoot portion of the foot of the wearer, the base portion has an lateral valley disposed at a location corresponding to the proximal bone head of the fifth metatarsal, and in a cutting plane when the sole structure is cut along the foot width direction at a location corresponding to the proximal bone head of the fifth metatarsal, the lateral valley of the base portion has a bowl shape such that a portion of the lateral valley located closer to an outer side than to the substantially center is recessed downward.

In the fourth aspect of the present disclosure, the valley of the base portion has such a bowl shape recessed downward along the proximal bone head of the fifth metatarsal. Such a configuration stably supports an outer region of the midfoot portion at the valley of the base portion when a load is applied to the proximal bone head of the fifth metatarsal and the first midsole portion is compressively deformed at a location corresponding to the proximal bone head of the fifth metatarsal. That is, the configuration reduces shift of the midfoot portion from the sole structure. This can maintain a positional relationship between the sustentaculum tali and the valley of the second support portion to maintain the above-described advantage of reducing sinking of the sustentaculum tali portion into the sole structure. This can achieve a favorable feeling of running.

A fifth aspect of the disclosure is an embodiment of the first or second aspect. In the fifth aspect, the support plate is disposed to include an area ranging from a location corresponding to the midfoot portion of the foot of the wearer to a location corresponding to the hindfoot portion of the foot of the wearer, and the peak of the first support portion is disposed at a location corresponding to the medial cuneiform and the navicular of the foot of the wearer.

In the fifth aspect of the present disclosure, the peak of the first support portion is disposed at the location corresponding to the medial cuneiform and the navicular. Thus, the peak of the first support portion is along the inner longitudinal arch, stably supporting the inner longitudinal arch. The above-described configuration can further reduce the overpronation. This can achieve a favorable feeling of running.

A sixth aspect of the disclosure is an embodiment of the first or second aspect. In the sixth aspect, the support plate includes at least one rib bridged between the first support portion and the second support portion.

In the sixth aspect of the present disclosure, the support plate has at least one rib bridged between the first support portion and the second support portion. Such a configuration can reduce deformation of the first support portion and the second support portion in an approaching direction. Such a configuration can further enhance the advantage of reducing sinking of the sustentaculum tali portion into the sole structure. This can achieve a favorable feeling of running.

A seventh aspect of the present disclosure is directed to a shoe including the sole structure of any one of the first to sixth aspects of the present disclosure.

In the seventh aspect, the shoe providing advantages similar to those of the first to sixth aspects of the present disclosure can be obtained.

As described above, the present disclosure can achieve a favorable feeling particularly during running.

DETAILED DESCRIPTION

Embodiments of the present disclosure will be described in detail with reference to the drawings. The following description of the embodiments is merely exemplary in nature, and is not intended to limit the scope, applications, or use of the present disclosure.

Embodiment

Sole Structure

Figure 1:
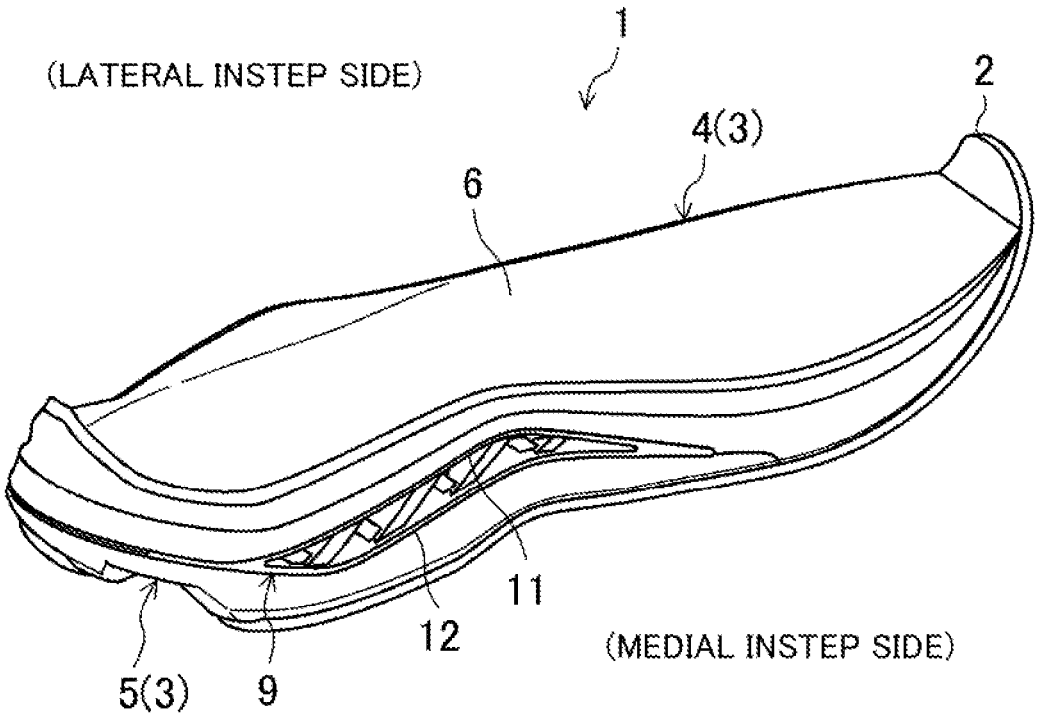
FIG. 1 is an overall perspective view illustrating a sole structure of an embodiment.

FIG. 1 illustrates the entirety of a sole structure 1 of an embodiment of the present disclosure. A shoe including the sole structure 1 is used as, e.g., a sports shoe for running or various competitions.

The drawings show the sole structure 1 for a left shoe only. A sole structure for a right shoe is symmetrical to the sole structure 1 for the left shoe. Thus, only the sole structure 1 for the left shoe will be described in the following description, and the description of the sole structure for the right shoe will be omitted herein.

In the following description, an upper side (upward, above) and a lower side (downward, below) represent a positional relationship in an up-down direction of the sole structure 1. Specifically, the upper side (upward, above) indicates a side on which a planta contact surface described later is located in the sole structure 1. The lower side (downward, below) indicates a side on which an outsole described later is located in the sole structure 1. Further, a front side and a rear side represent a positional relationship in a foot length direction of the sole structure 1. Specifically, the front side indicates the side (see FIG. 3) of the sole structure 1 at a location corresponding to a toe portion of a foot (ft) of a wearer. The rear side indicates the side (see FIG. 3) of the sole structure at a location corresponding to a heel portion of the foot ft of the wearer. Further, an inner side and an outer side each indicate a medial instep side and a lateral instep side in the shoe including the sole structure 1. That is, with respect to the center (the center in a foot width direction) of the foot viewed in the foot length direction, a direction toward an opposing foot is referred to as the inner side, and a direction away from the opposing foot is referred to as the outer side. In addition, in FIG. 3, in the sole structure 1, an area corresponding to a forefoot portion of a foot ft of a person (hereinafter, referred to as a "wearer") wearing the shoe including the sole structure 1 is indicated by a reference sign F, an area corresponding to a midfoot portion of the foot ft of the wearer is indicated by a reference sign M, and an area corresponding to a hindfoot portion of the foot ft of the wearer is indicated by a reference sign H.

The above-described "sustentaculum tali (SC)" generally indicates a protrusion which is part of bones of the foot ft, is located on the front side with respect to the substantially center of the calcaneus (HL) of the foot ft in the foot length direction, and protrudes substantially horizontally inward in the foot width direction. In the following description, for the sake of convenience in description of each element of the sole structure 1, a portion excluding the "sustentaculum tali SC" will be referred to as the "calcaneus HL."

<Outsole>

The sole structure 1 includes the outsole 2 (see FIGS. 1 to 6). In the sole structure 1, the outsole 2 is disposed so as to correspond to an area ranging from the forefoot portion (F) to the hindfoot portion (H) of the foot ft.

The outsole 2 is formed of a hard elastic member having a higher hardness than a midsole 3 that will be described later. Specifically, examples of the material suitable for the outsole 2 include thermoplastic synthetic resins such as an ethylene-vinyl acetate copolymer (EVA), thermosetting resins such as polyurethane (PU), and rubber such as butadiene rubber and chloroprene rubber. The hardness of the outsole 2 is preferably set to, e.g., 50 C to 80 A (more preferably 60 A to 70 A) in a durometer C or A.

<Midsole>

Figure 14:
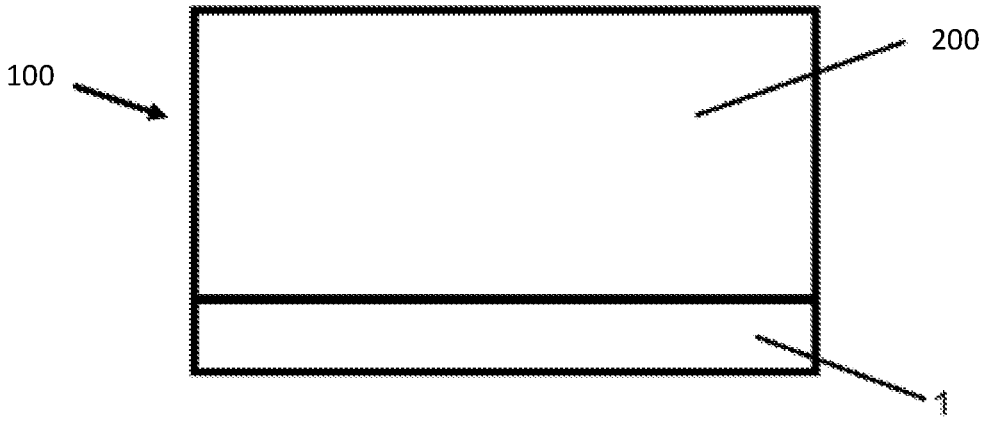
FIG. 14 is a cross-sectional view of an upper and the sole structure.

The sole structure 1 includes the midsole 3 (see FIGS. 1 to 6). The midsole 3 is configured to support a planta surface. The midsole 3 is stacked on the upper side of the outsole 2 with an adhesive, for example. Note that in the shoe 100 including the sole structure 1, an upper 200 (e.g., depicted in FIG. 14) for covering the foot ft is provided at a peripheral edge (a peripheral edge of the later-described planta contact surface) of the midsole 3.

The midsole 3 has a first midsole portion 4 and a second midsole portion 5. The first midsole portion 4 and the second midsole portion 5 are made of soft elastic materials having a lower rigidity than the outsole 2. Specifically, examples of the materials suitable for the first midsole portion 4 and the second midsole portion 5 include thermoplastic synthetic resins such as an ethylene-vinyl acetate copolymer (EVA) and foams thereof, thermosetting resins such as polyurethane (PU) and foams thereof, and rubber such as butadiene rubber and chloroprene rubber and foams thereof.

The first midsole portion 4 is disposed at a location corresponding to the entire planta in the sole structure 1. The first midsole portion 4 is disposed on a side on which the foot ft is located (see FIGS. 5 and 6). An upper surface of the first midsole portion 4 serves as a planta contact surface 6 for supporting the planta of the wearer.

The second midsole portion 5 is disposed in an area ranging from a location corresponding to the midfoot portion (M) to a location corresponding to the hindfoot portion H in the sole structure 1. The second midsole portion 5 is disposed on a side on which the outsole 2 is located with respect to a later-described support plate 9. The second midsole portion 5 is provided with a hole 7 penetrating a part of the second midsole portion 5 in the thickness direction (see FIGS. 2, 4, and 10 to 13).

<Support Plate>

Figure 2:
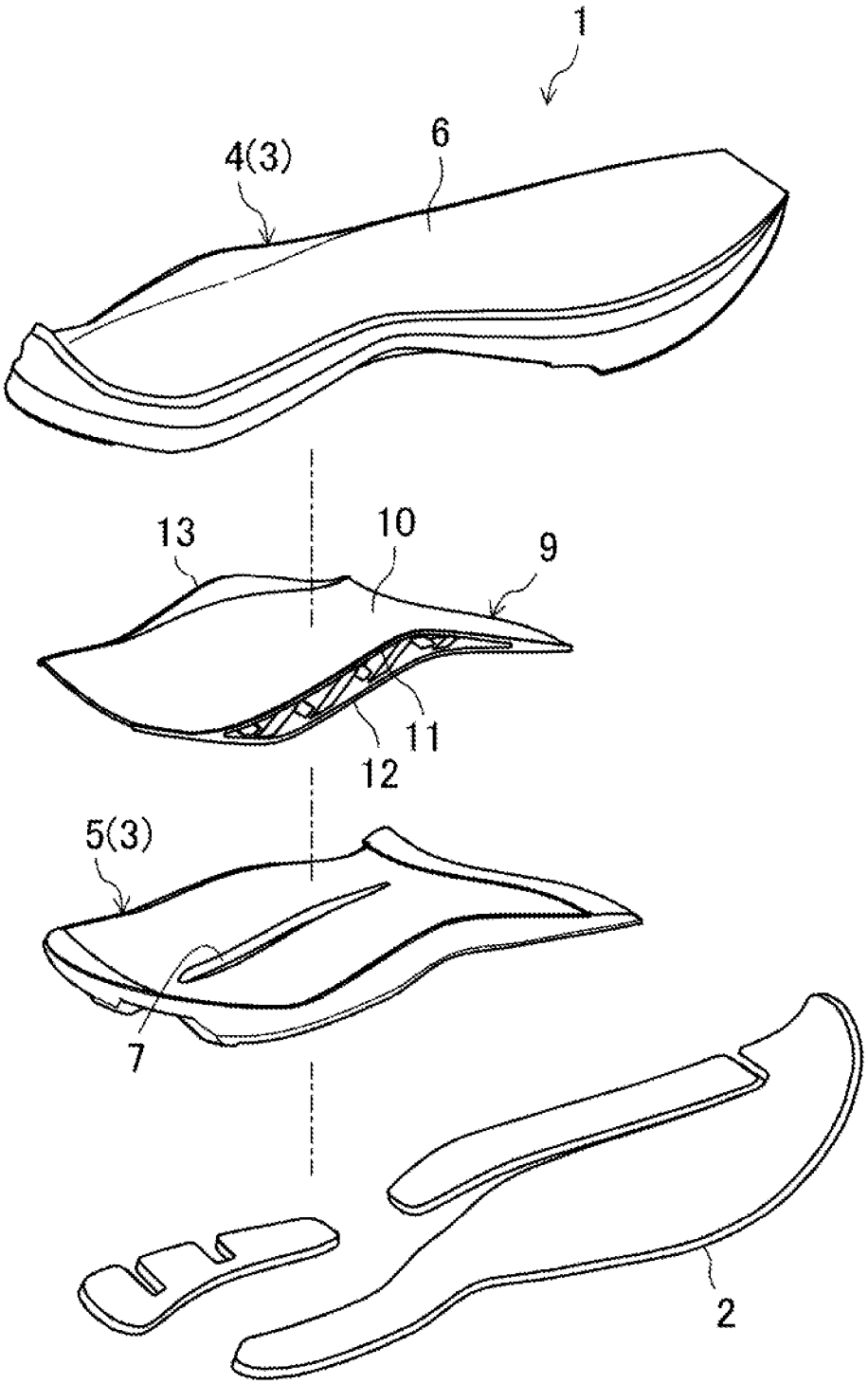
FIG. 2 is an exploded perspective view illustrating each configuration of the sole structure of the embodiment.
Figure 3:
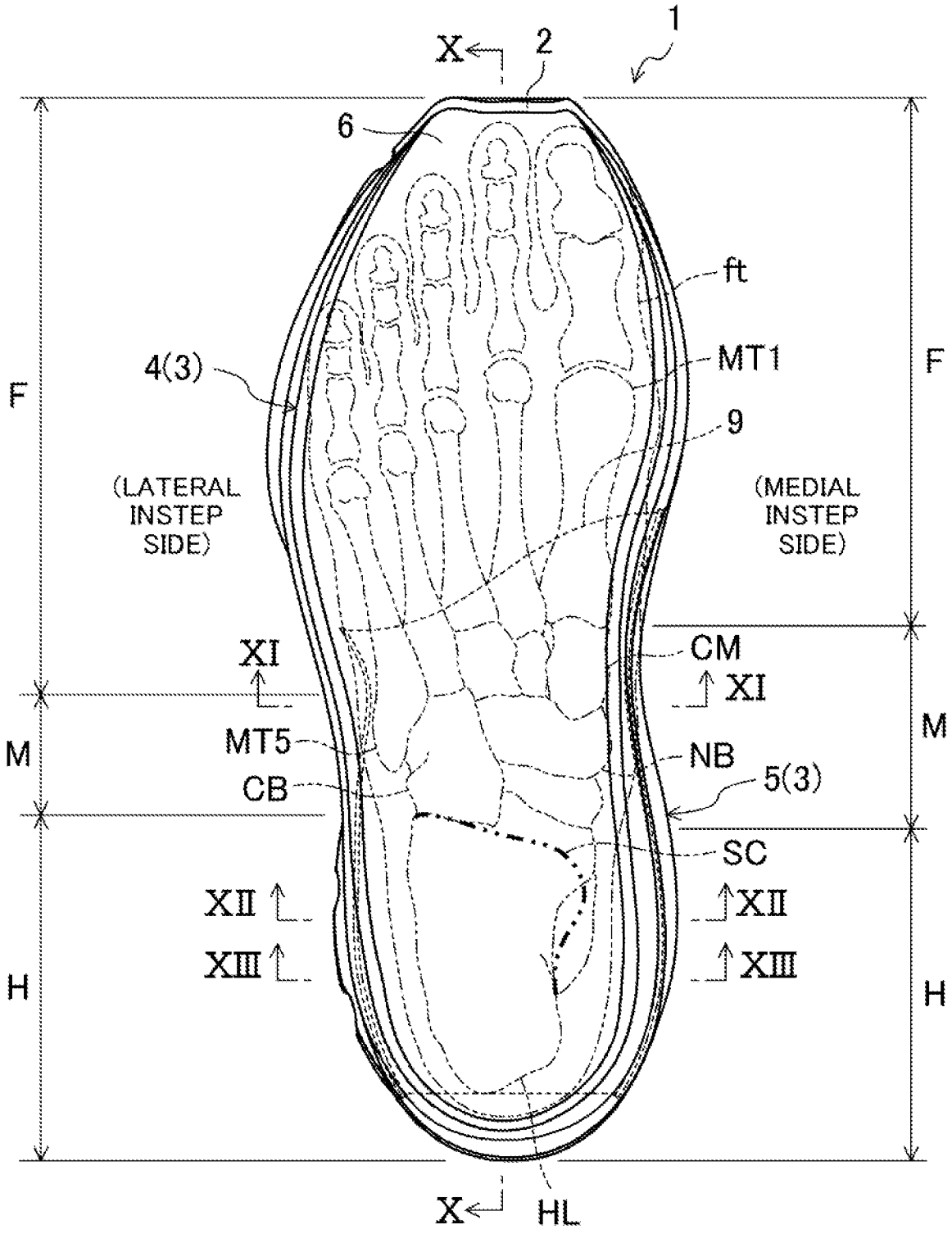
FIG. 3 is a top view virtually illustrating a state in which a skeletal structure of a foot of a wearer is on the sole structure of the embodiment.
Figure 4:
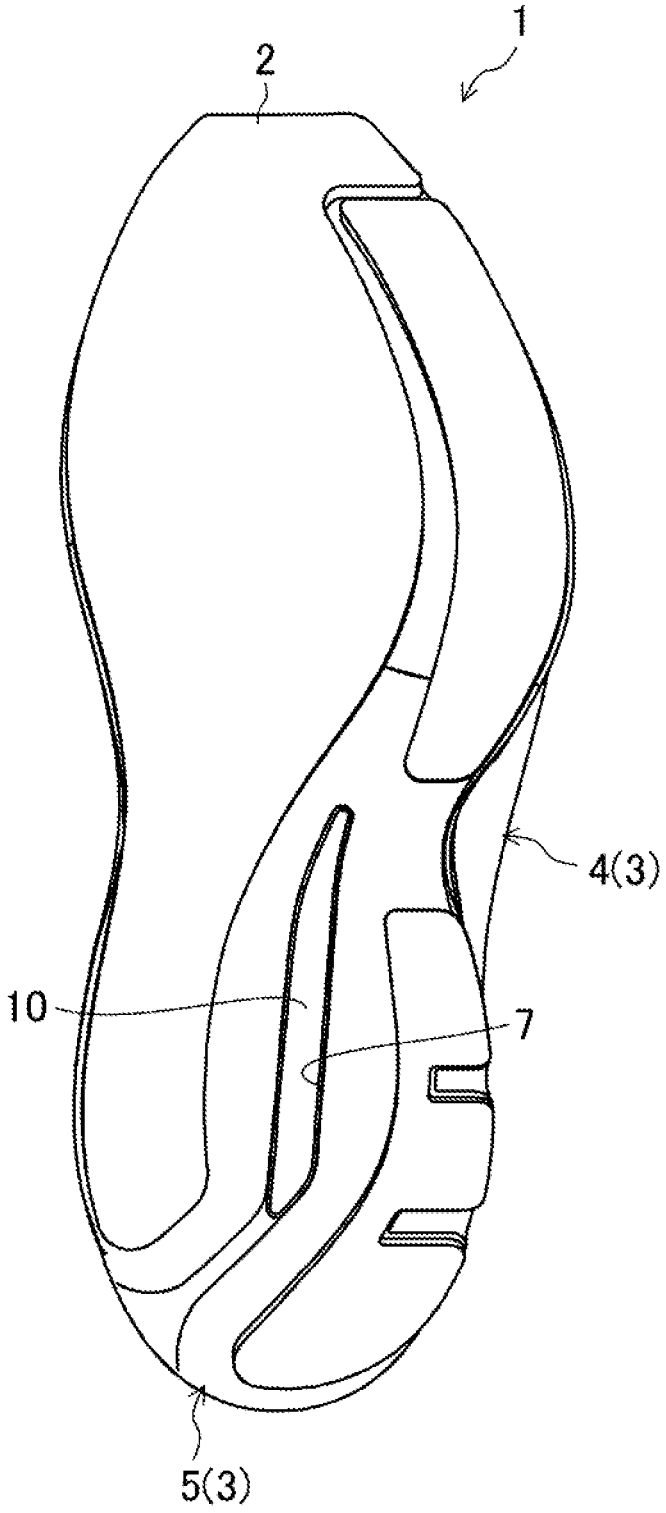
FIG. 4 is a perspective view illustrating the sole structure of the embodiment from the bottom.
Figure 10:
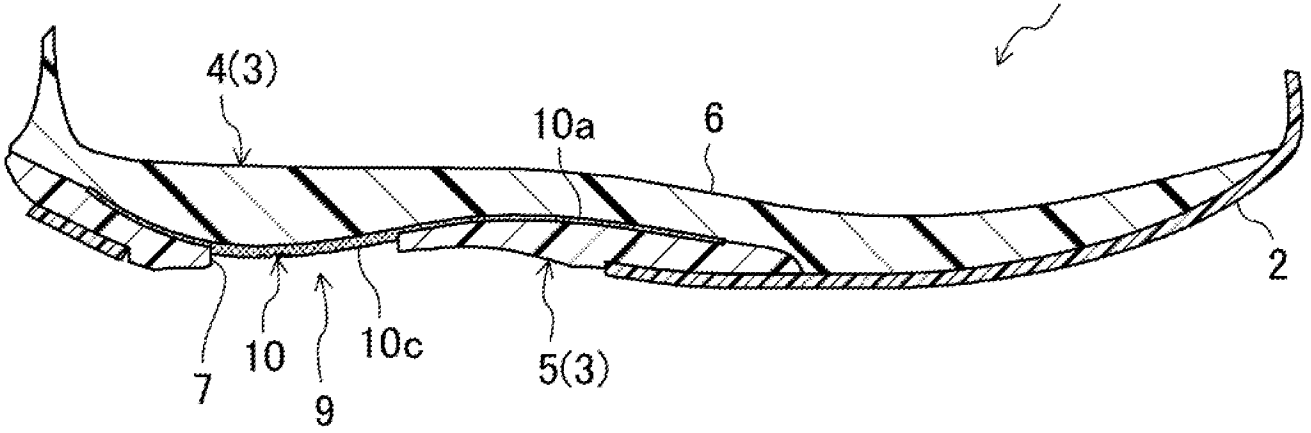
FIG. 10 is a cross-sectional view taken along line X-X illustrated in FIG. 3.
Figure 13:
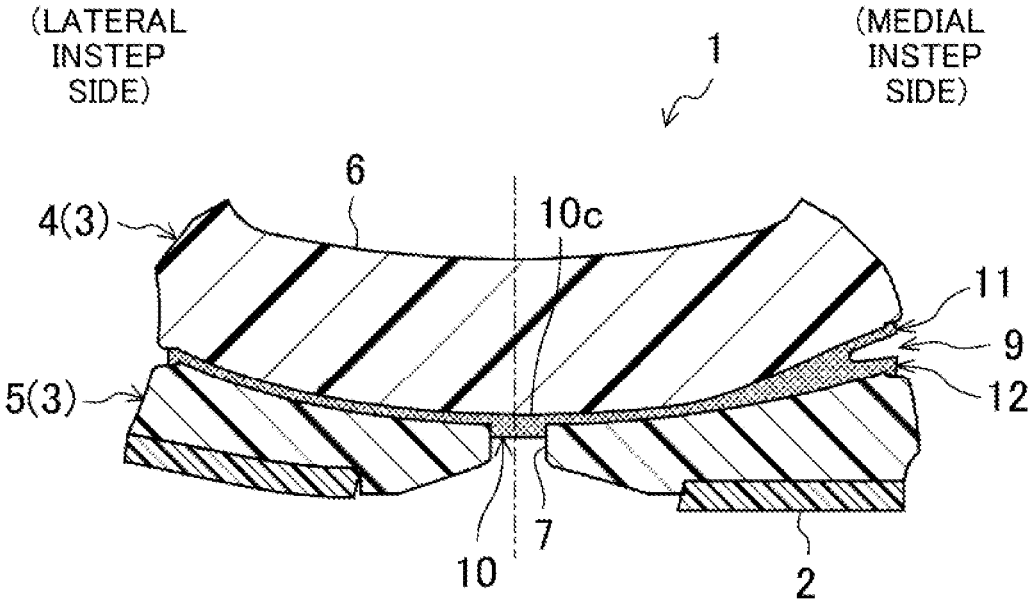
FIG. 13 is a cross-sectional view taken along line XIII-XIII illustrated in FIG. 3.

The sole structure 1 includes the support plate 9 (see FIGS. 1 to 3). The support plate 9 is disposed in an area ranging from a location corresponding to the midfoot portion M to a location corresponding to the hindfoot portion H in the sole structure 1 (see FIG. 3). As illustrated in FIGS. 10 and 13, the support plate 9 is stacked between the first midsole portion 4 and the second midsole portion 5.

The support plate 9 is a member for enhancing rigidity in the area ranging from the location corresponding to the midfoot portion M to the location corresponding to the hindfoot portion H in the sole structure 1. The support plate 9 includes a thin layer having a higher rigidity than the outsole 2 and the midsole 3, and is preferably made of a hard elastic material.

Specific examples of the hard elastic material include thermoplastic resins such as thermoplastic polyurethane (TPU), polyamide elastomer (PAE), and an acrylonitrile butadiene styrene (ABS) resin, and thermosetting resins such as an epoxy resin and an unsaturated polyester resin. The support plate 9 may be made from a fiber-reinforced plastic (FRP) containing carbon fibers, aramid fibers, or glass fibers as reinforcement fibers, and a thermosetting resin or a thermoplastic resin as a matrix resin.

Figure 7:
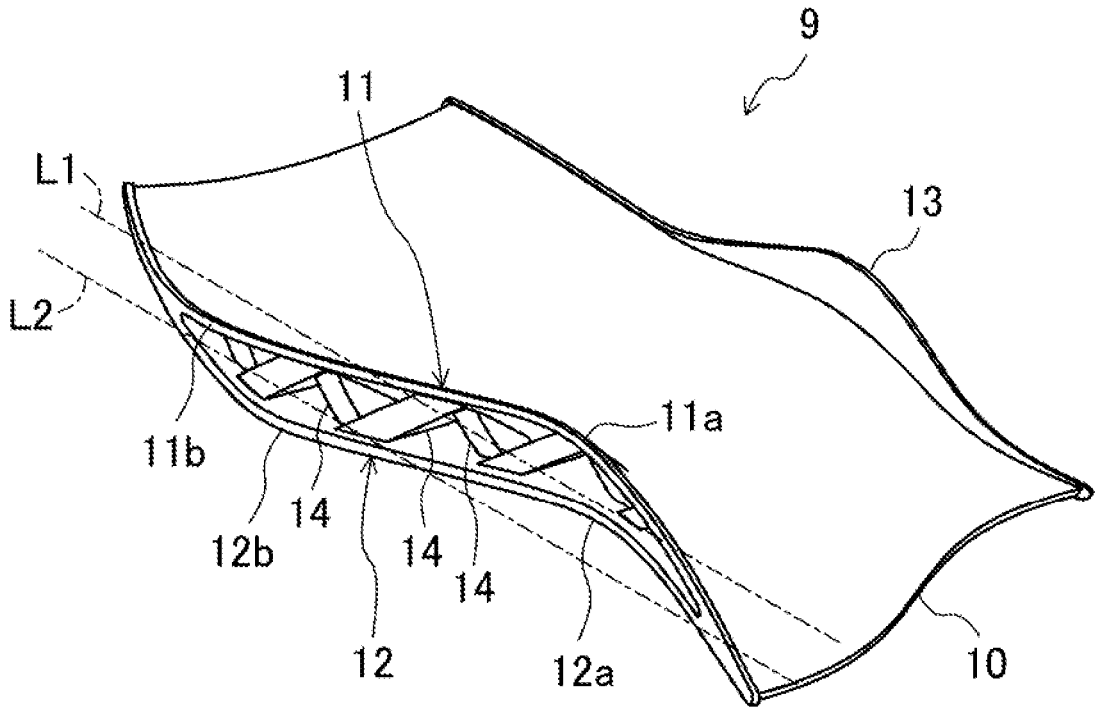
FIG. 7 is a perspective view illustrating a support plate.
Figure 8:
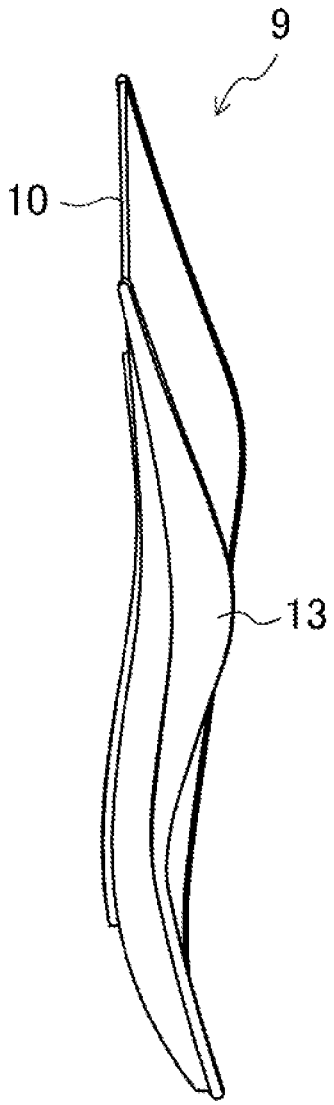
FIG. 8 is a side view illustrating the support plate from the outer side.

As illustrated in FIGS. 2 and 7, the support plate 9 includes a base portion 10, a first support portion 11, and a second support portion 12. The base portion 10, the first support portion 11, and the second support portion 12 are formed integrally with each other.

<Base Portion>

The base portion 10 has substantially a plate-like shape. The base portion 10 has a corrugated shape with peaks 10*a* and valleys 10*c* alternately repeated in the foot length direction (see FIG. 10).

The peak 10*a* is formed at a location corresponding to the midfoot portion M (see FIG. 10). The peak 10*a* is formed along the shape of the plantar arch of the foot ft.

The valley 10*c* is formed at a location corresponding to the calcaneus HL (see FIG. 10). The valley 10*c* of the base portion 10 supports the location corresponding to the calcaneus HL from below. In a cutting plane when the sole structure 1 is cut along the foot width direction at a location corresponding to the calcaneus HL, the valley 10*c* has a bowl shape such that a substantially center portion thereof is recessed downward (see FIG. 13).

Note that the lowermost portion of the valley 10*c* illustrated in FIG. 10 is preferably in a region extending forward from a rear end portion of the planta contact surface 6 by a length of 10% to 20% of the planta contact surface 6 in the foot length direction, and the lowermost portion of the valley 10*c* illustrated in FIG. 13 is preferably in a region extending, in the foot width direction, outward from an inner end portion of the support plate 9 in the foot width direction by a length of 45% to 55% of the entire width, i.e., the substantially center in the width direction, of the support plate 9 (see FIG. 13).

In a cutting plane (see FIG. 11) when the sole structure 1 is cut in the foot width direction at a location corresponding to the proximal bone head (see FIG. 3) of the fifth metatarsal (MT5), the base portion 10 has an lateral valley 10*b* formed recessed downward on the outer side. That is, the lateral valley 10*b* supports the location corresponding to the proximal bone head of the fifth metatarsal MT5 from below. The lateral valley 10*b* has a bowl shape such that a portion thereof located closer to the outer side than to the substantially center in the foot width direction is recessed downward (see FIG. 11).

As illustrated in FIGS. 2 and 6 to 8, a side wall portion 13 is provided at the base portion 10. The side wall portion 13 is formed to stand upward from a peripheral edge portion located on the outer side of the base portion 10 (see FIGS. 11 and 12). The side wall portion 13 extends along the foot length direction. The side wall portion 13 is disposed at a location corresponding to the outer longitudinal arch of the foot ft in the sole structure 1 (see FIG. 6).

<First Support Portion and Second Support Portion>

Figure 11:
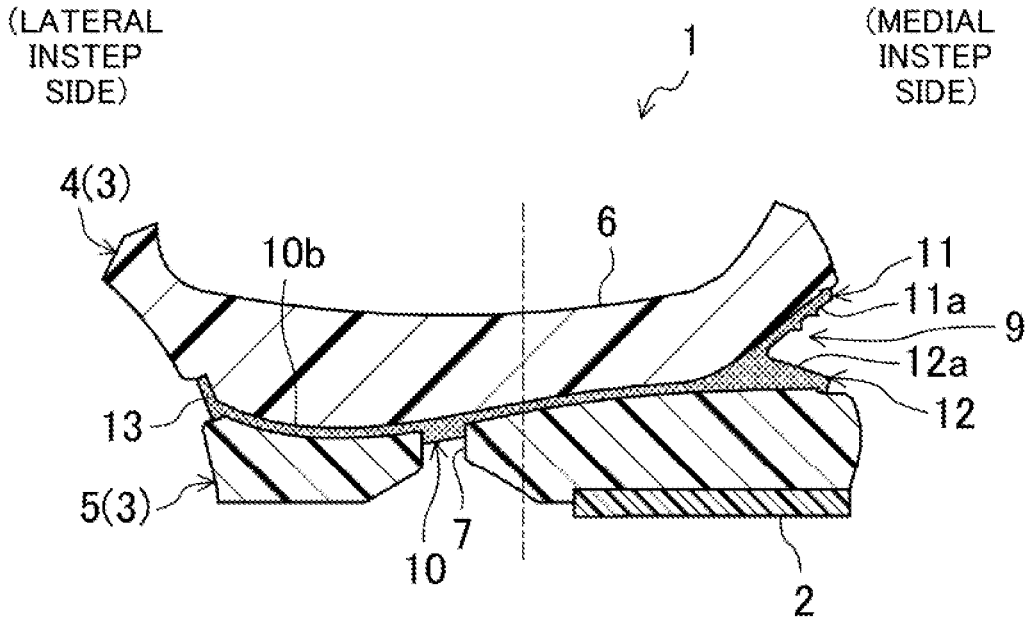
FIG. 11 is a cross-sectional view taken along line XI-XI illustrated in FIG. 3.
Figure 12:
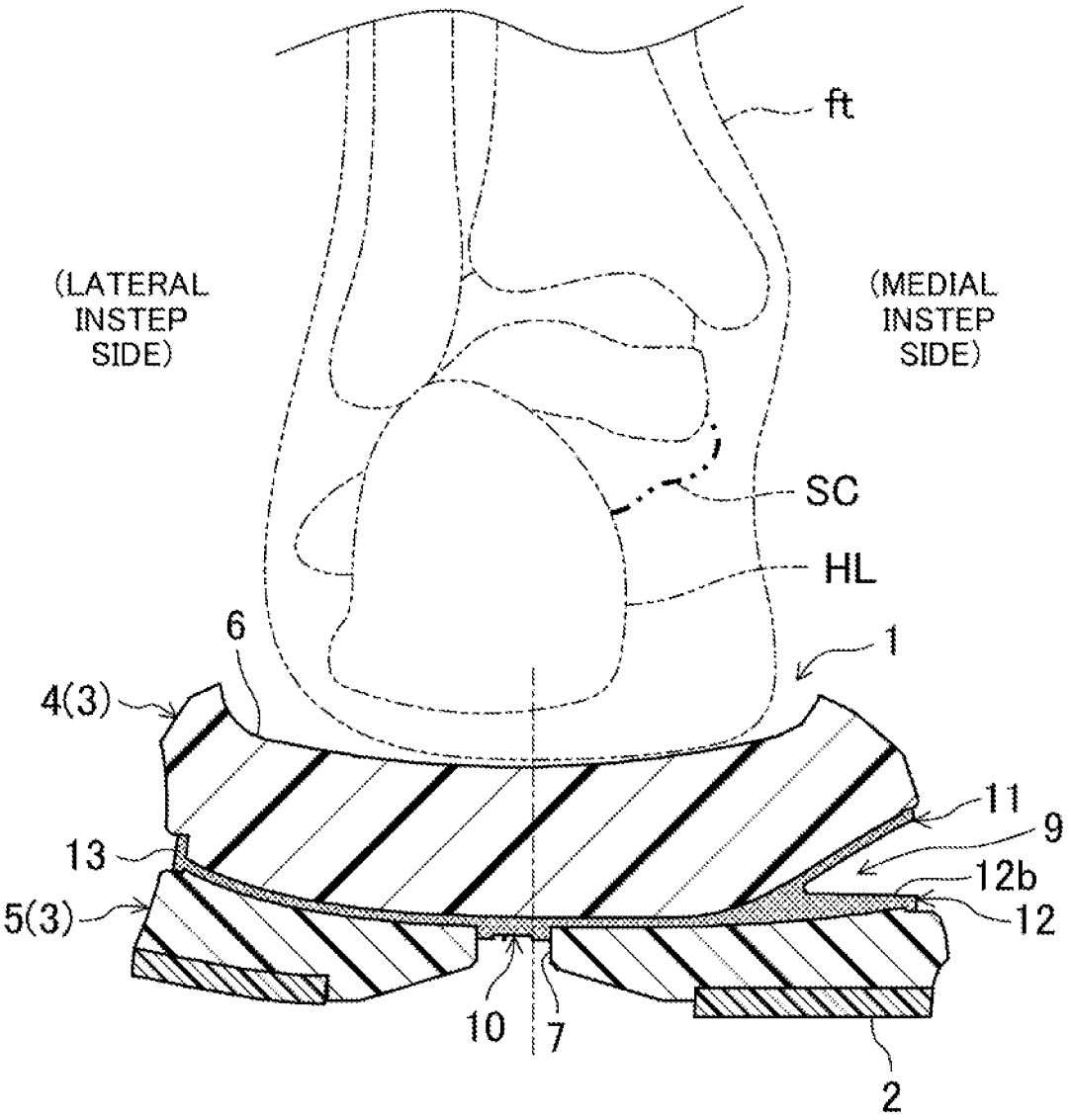
FIG. 12 is a cross-sectional view taken along line XII-XII illustrated in FIG. 3.

The first support portion 11 and the second support portion 12 are, in a cutting plane when the sole structure 1 is cut along the foot width direction, branched apart from each other from a peripheral edge portion located on the inner side of the base portion 10 toward peripheral edge portions located on the inner sides of the first midsole portion 4 and the second midsole portion 5, respectively (see FIGS. 11 to 13). That is, the support plate 9 has a double structure in which a plate-shaped portion is vertically branched on the inner side. This double structure is formed at least in an area ranging from a location corresponding to the sustentaculum tali SC to a location corresponding to the medial cuneiform (CM).

Figure 5:
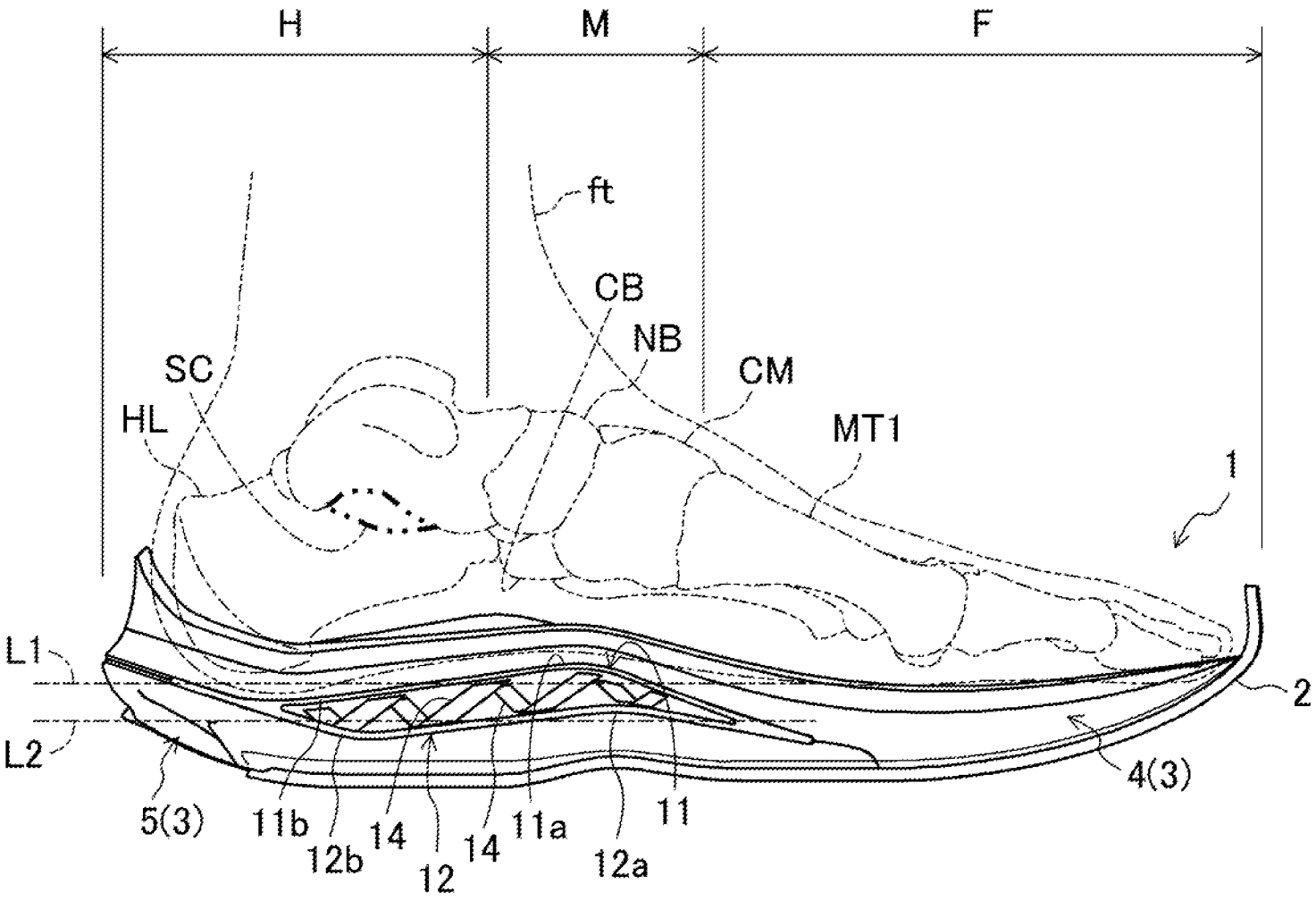
FIG. 5 is a side view illustrating the sole structure of the embodiment from the inner side.
Figure 6:
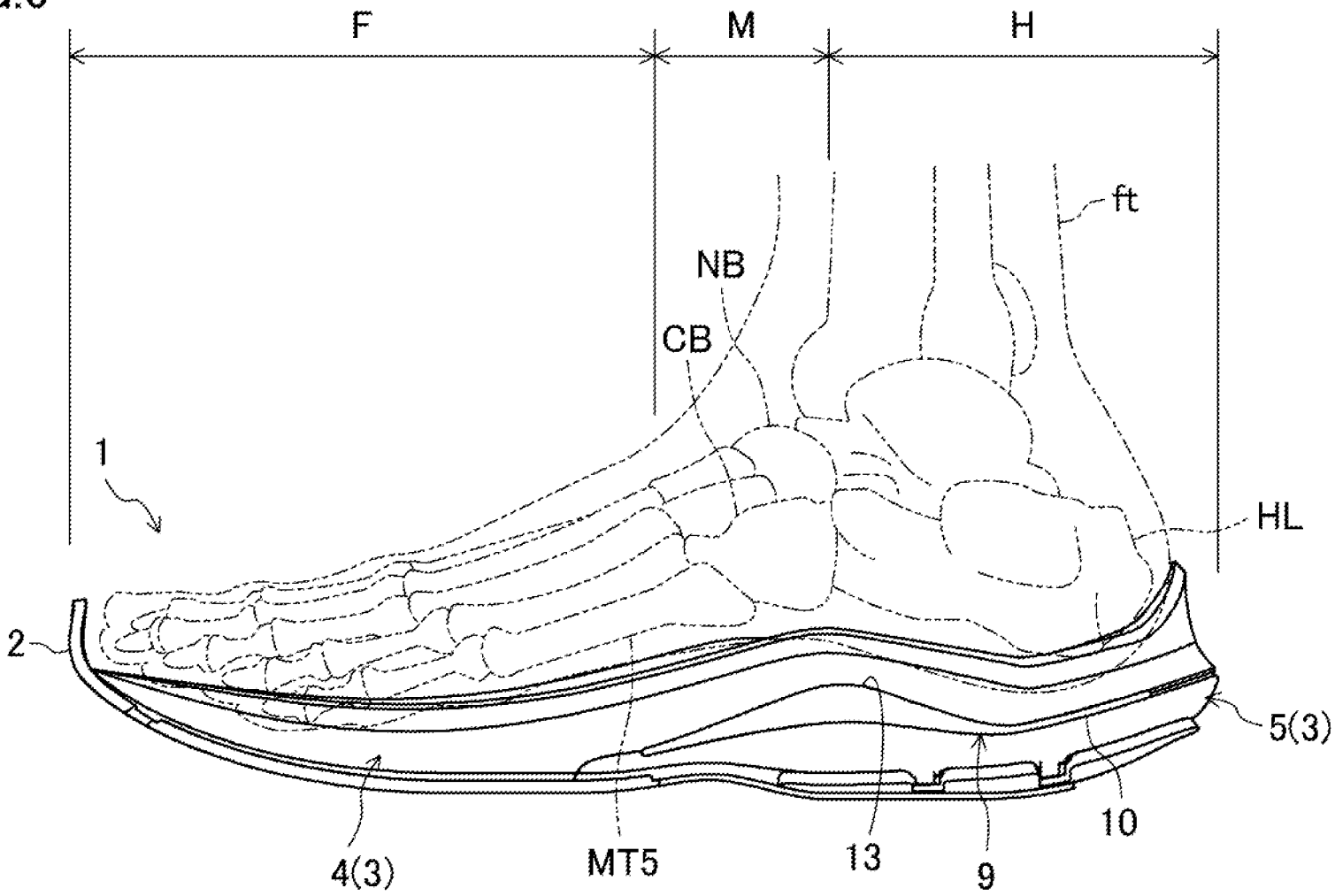
FIG. 6 is a side view illustrating the sole structure of the embodiment from the outer side.
Figure 9:
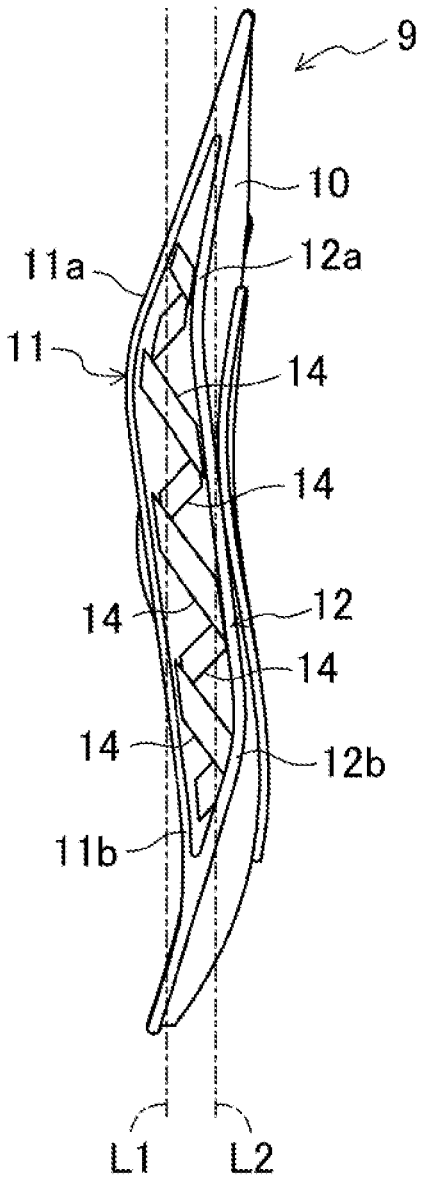
FIG. 9 is a side view illustrating the support plate from the inner side.

In a side view from the inner side, a front portion of the first support portion 11 and a front portion of the second support portion 12 vertically overlap each other (see FIGS. 5, 7, and 9). Moreover, a rear portion of the first support portion 11 and a rear portion of the second support portion 12 vertically overlap each other. Intermediate portions of the first support portion 11 and the second support portion 12 are apart from each other in the up-down direction.

The first support portion 11 has a corrugated shape with peaks 11*a* and valleys 11*b* alternately repeated in the foot length direction (see FIGS. 5, 7, and 9). An upper surface of the first support portion 11 is continuous with an upper surface of the base portion 10.

Here, a reference line (L1) is a line (a phantom line) serving as a reference of the corrugated shape forming the first support portion 11 in a side view of the support plate 9 from the inner side (see FIGS. 7 and 9). The peak 11*a* of the first support portion 11 is located above the reference line L1, and on the other hand, the valley 11*b* of the first support portion 11 is located below the reference line L1.

The peak 11*a* of the first support portion 11 is disposed at a location corresponding to the medial cuneiform CM and the navicular (NB) (see FIG. 5). That is, the peak 11*a* of the first support portion 11 is configured to support the highest portion of the inner longitudinal arch of the foot ft from below. Note that the inner longitudinal arch typically corresponds to a portion (the so-called plantar arch) including the hallux metatarsal, the medial cuneiform CM, the navicular NB, the talus, and the calcaneus HL.

The second support portion 12 is located below the first support portion 11 (FIGS. 5, 7, and 9). The second support portion 12 has a corrugated shape with peaks 12*a* and valleys 12*b* that are alternately repeated in the foot length direction. In the present embodiment, the corrugated shape of the second support portion 12 is different from the corrugated shape of the first support portion 11. For example, the locations of the peak 11*a* of the first support portion 11 and the peak 12*a* of the second support portion 12 are slightly shifted from each other in the foot length direction (see FIGS. 5 and 7).

A reference line (L2) is a line (a phantom line) serving as a reference of the corrugated shape forming the second support portion 12 in the side view of the support plate 9 from the inner side (see FIGS. 5, 7, and 9). The reference line L2 is located below the reference line L1. The reference line L2 extends substantially in parallel with the reference line L1 along the foot length direction. The peak 12*a* of the second support portion 12 is located above the reference line L2, and on the other hand, the valley 12*b* of the second support portion 12 is located below the reference line L2.

The peak 12*a* of the second support portion 12 is disposed at a location corresponding to the medial cuneiform CM (see FIGS. 5 and 11). That is, the peak 12*a* of the second support portion 12 is configured to support the location corresponding to the medial cuneiform CM from below. Note that the peak 12*a* of the second support portion 12 may be disposed to include a location corresponding to a joint (the Lisfranc joint) between the proximal bone head of the first metatarsal (MTI) and the medial cuneiform CM.

As a feature of the present disclosure, the valley 12*b* of the second support portion 12 is disposed at the location corresponding to the sustentaculum tali SC (see FIGS. 5 and 12). Specifically, the valley 12*b* of the second support portion 12 is disposed such that the lowermost portion thereof is located below the location corresponding to the sustentaculum tali SC. That is, the valley 12*b* of the second support portion 12 is configured to support the location corresponding to the sustentaculum tali SC from below. At a location corresponding to the sustentaculum tali SC in the sole structure 1, a portion of the second midsole portion 5 located below the valley 12*b* of the second support portion 12 has a relatively thin thickness. Note that in FIG. 12, ribs 14 that will be described later are not illustrated.

<Rib>

The support plate 9 has the plurality of ribs 14 (see FIGS. 5, 7, and 9). The plurality of ribs 14 is made of the same material as the support plate 9. The plurality of ribs 14 is formed integrally with the support plate 9. Each rib 14 is bridged between the first support portion 11 and the second support portion 12. Adjacent ones of the ribs 14 in the foot length direction are disposed such that upper end portions thereof are continuous with each other at the location of a lower surface of the first support portion 11. In addition, adjacent ones of the ribs 14 in the foot length direction are disposed such that lower end portions thereof are continuous with each other at the location of an upper surface of the second support portion 12.

Advantages of Embodiment

In general, a runner who prefers efficient running with a better feeling of running tends to require running shoes to have cushioning properties when the running shoes contact a ground or road surface during running (hereinafter referred to as "upon grounding"). Upon grounding, an impact (an initial impact) mainly in the vertical up-down direction is generated around the hindfoot portion H (the heel portion) of the foot ft of the wearer. The above-described impact is appropriately attenuated by the cushioning properties. On the other hand, a sole structure with higher cushioning properties tends to generate a phenomenon called pronation in which the calcaneus HL of the foot ft of the wearer falls inward after the grounding.

Here, the mechanism of the pronation will be specifically described. In general, a load (a body weight) on the foot ft during running is strongly applied to the sustentaculum tali SC mainly through the tibia and the talus. When the load during running is concentrated on the sustentaculum tali SC, the sustentaculum tali SC becomes instable, and the calcaneus HL moves to fall inward. The tension of a muscle group at the inner longitudinal arch of the foot ft typically supports the falling sustentaculum tali SC to reduce such falling movement. This appropriately attenuates the impact upon grounding. However, an insufficient tension of the muscle group at the inner longitudinal arch or inappropriate arrangement (so-called skeletal alignment) of bones and joints of the foot ft generates movement called overpronation in which the calcaneus HL falls excessively. Due to the structure of the foot joints, such overpronation also causes inner rotation of a lower leg at the same time as the falling movement of the calcaneus HL. As a result, excessive stress is also on muscles and ligaments in the vicinity of a knee joint and/or in the vicinity of a hip joint. That is, when the overpronation occurs, a load is on various portions of the lower leg linked to the calcaneus HL, and a running disorder accompanied by chronic pain may occur at these portions. As described above, the sustentaculum tali SC serves as a starting point at which the pronation occurs. For reducing the above-described overpronation, it is important to stably support the sustentaculum tali SC during running.

Based on such findings, the sole structure 1 of the present embodiment have the following configuration. That is, the sole structure 1 includes the first midsole portion 4, the second midsole portion 5, and the support plate 9 stacked between these portions 4 and 5, and the support plate 9 has the first and second support portions 11 and 12 branched apart from each other from the peripheral edge portion located on the inner side of the base portion 10 toward the first midsole portion 4 and the second midsole portion 5, respectively. According to this configuration, the soft first midsole portion 4 and the soft second midsole portion 5 can provide the cushioning properties to the sole structure 1 and the hard support plate 9 can stably support the planta. In addition, the support plate 9 has the double structure including the first and second support portions 11 and 12 vertically branched from the peripheral edge portion located on the inner side of the base portion 10. This can particularly increase the rigidity of a portion corresponding to the inner side of the foot ft to particularly stably support the inner longitudinal arch of the foot ft. The second support portion 12 has the valley 12*b* disposed at the location corresponding to the sustentaculum tali SC. This allows the second midsole portion 5 to have a thinner thickness at the location corresponding to the sustentaculum tali SC. That is, the second midsole portion 5 is thinner below the valley 12*b* than below the peak 12*a* of the second support portion 12 (see FIGS. 11 and 12). This can particularly enhance the rigidity of the portion supporting the sustentaculum tali SC as the starting point of the overpronation, possibly reducing sinking of the sole structure 1 at the sustentaculum tali SC portion (see FIG. 12). The above-described configuration can reduce the overpronation. This can achieve a favorable feeling of running.

In addition, in the present embodiment, the lowermost portion of the valley 12*b* of the second support portion 12 is disposed at the location corresponding to the sustentaculum tali SC. Such a disposition can maximize the rigidity of the portion supporting the sustentaculum tali SC as the starting point of occurrence of the overpronation to reduce the overpronation. This can achieve a favorable feeling of running.

In addition, in the present embodiment, the valley 10*c* of the base portion 10 has such a bowl shape recessed downward along the calcaneus HL. Such a configuration stably supports the hindfoot portion H at the valley 10*c* of the base portion 10 when a load is applied to the calcaneus HL and the first midsole portion 4 is compressively deformed at a location corresponding to the hindfoot portion H. That is, such a configuration reduces shift of the hindfoot portion H from the sole structure 1. This can maintain the positional relationship between the sustentaculum tali SC and the valley 12*b* of the second support portion 12 to maintain the above-described advantage of reducing sinking of the sustentaculum tali SC portion into the sole structure 1. This can achieve a favorable feeling of running.

In addition, in the present embodiment, the lateral valley 10*b* of the base portion 10 has such a bowl shape recessed downward along the proximal bone head of the fifth metatarsal MT5 (see FIG. 11). Such a configuration stably supports an outer region of the midfoot portion M at the lateral valley 10*b* of the base portion 10 when a load is applied to the proximal bone head of the fifth metatarsal MT5 and the first midsole portion 4 is compressively deformed at a location corresponding to the proximal bone head of the fifth metatarsal MT5. That is, such a configuration reduces shift of the midfoot portion M from the sole structure 1. This can maintain the positional relationship between the sustentaculum tali SC and the valley 12*b* of the second support portion 12 to maintain the advantage of reducing sinking of the sustentaculum tali SC portion into the sole structure 1. This can achieve a favorable feeling of running.

In addition, the peak 11*a* of the first support portion 11 is disposed at the location corresponding to the medial cuneiform CM and the navicular NB. Thus, the peak 11*a* of the first support portion 11 is along the inner longitudinal arch, stably supporting the inner longitudinal arch. The above-described configuration can further reduce the overpronation. This can achieve a favorable feeling of running.

In addition, in the present embodiment, the support plate 9 has at least one rib 14 bridged between the first support portion 11 and the second support portion 12. Such a configuration can reduce deformation of the first support portion 11 and the second support portion 12 in an approaching direction. Such a configuration can further enhance the advantage of reducing sinking of the sustentaculum tali SC portion into the sole structure 1. This can achieve a favorable feeling of running.

OTHER EMBODIMENTS

In the above-described embodiment, the valley 12*b* of the second support portion 12 is disposed such that the lowermost portion thereof is located below the location corresponding to the sustentaculum tali SC. The lowermost portion of the valley 12*b* of the second support portion 12 may be slightly shifted from a location immediately below the sustentaculum tali SC. The valley 12*b* of the second support portion 12 may be located below the sustentaculum tali SC.

In addition, in the above-described embodiment, the upper end portions of adjacent ribs 14 are continuous with each other at the lower surface of the first support portion 11 and the lower end portions of adjacent ribs 14 are continuous with each other at the upper surface of the second support portion 12. However, the configuration of the ribs 14 is not limited thereto. Any configuration may be applied as long as it can reduce deformation of the first support portion 11 and the second support portion 12 in the approaching direction.

Although the embodiments of the present disclosure have been described above, the present disclosure is not limited to the above embodiments, and various modifications can be made within the scope of the present disclosure.

The present disclosure is industrially usable as, for example, a sole structure 1 for a shoe applied to running or various competitions and a shoe having such a sole structure 1.

What is claimed is:

1. A sole structure for a shoe, the sole structure comprising:

a first midsole portion disposed on a side of the sole structure configured to face a planta surface of a foot of a wearer;

a second midsole portion disposed below the first midsole portion; and a support plate stacked between the first midsole portion and the second midsole portion, disposed at least at a location configured to correspond to a hindfoot portion of the foot of the wearer, and having a higher rigidity than the first midsole portion and the second midsole portion, the support plate including:

a base portion having a corrugated shape with at least one peak and at least one valley, and first and second support portions branched apart from each other from a peripheral edge portion located on a medial side of the base portion toward the first midsole portion and the second midsole portion, respectively, the first and second support portions extending approximately the same length along the base portion, the first support portion having an upper surface continuous with an upper surface of the base portion and having a corrugated shape defined by a peak that is convex upward and a valley that is convex downward, the second support portion being located below the first support portion and having a corrugated shape defined by a peak that is convex upward and a valley that is convex downward, the peak of the second support portion being both a frontmost peak and a rearmost peak of the second support portion and the valley of the second support portion being both a frontmost valley and a rearmost valley of the second support portion, the peak of the second support portion being disposed at a location on a front side relative to the valley of the second support portion in a foot-length direction and configured to correspond to a medial cuneiform of the foot of the wearer, and the valley of the second support portion being disposed at a location configured to correspond to a sustentaculum tali of the foot of the wearer.

2. The sole structure of claim 1, wherein the valley of the second support portion has a lowermost portion disposed at the location configured to correspond to the sustentaculum tali of the foot of the wearer.

3. The sole structure of claim 1, wherein the at least one valley of the base portion is disposed at a location configured to correspond to a calcaneus of the foot of the wearer, and in a cutting plane when the sole structure is cut along a foot width direction at the location configured to correspond to the calcaneus of the foot of the wearer, the at least one valley of the base portion has a concave shape such that a substantially center portion of the at least one valley is recessed downward.

4. The sole structure of claim 1, wherein the support plate includes an area ranging from a location corresponding to a midfoot portion of the sole structure to a location corresponding to a hindfoot portion of the sole structure, the base portion has a lateral valley disposed at a location corresponding to a proximal bone head of a fifth metatarsal of the foot of the wearer, and in a cutting plane when the sole structure is cut along the foot-width direction at a location configured to correspond to the proximal bone head of the fifth metatarsal of the foot of the wearer, the lateral valley of the base portion has a concave shape such that a portion of the lateral valley located closer to a lateral side of the sole structure than to a substantially center portion is recessed downward.

5. The sole structure of claim 1, wherein the support plate is disposed in the sole structure to include an area ranging from a location corresponding to a midfoot portion of the sole structure to a location corresponding to a hindfoot portion of the sole structure, and the peak of the first support portion is disposed at a location configured to correspond to a medial cuneiform and a navicular of the foot of the wearer.

6. The sole structure of claim 1, wherein the support plate includes at least one rib bridged between the first support portion and the second support portion.

7. A shoe comprising the sole structure of claim 1 and an upper.

* * * * *